US010648469B2

(12) United States Patent
Nofal et al.

(10) Patent No.: US 10,648,469 B2
(45) Date of Patent: May 12, 2020

(54) REMOTE PUMP MANAGING DEVICE

(71) Applicant: Lincus, Inc., Tempe, AZ (US)

(72) Inventors: Jorj Nofal, Phoenix, AZ (US); Sabarish Vinod, Chandler, AZ (US); Keith Tonkinson, Queen Creek, AZ (US)

(73) Assignee: Lincus, Inc., Tempe, AZ (US)

( * ) Notice: Subject to any disclaimer, the term of this patent is extended or adjusted under 35 U.S.C. 154(b) by 0 days.

(21) Appl. No.: 16/452,314

(22) Filed: Jun. 25, 2019

(65) Prior Publication Data

US 2019/0376510 A1 Dec. 12, 2019

Related U.S. Application Data

(63) Continuation-in-part of application No. 15/414,893, filed on Jan. 25, 2017, now Pat. No. 10,364,816.

(51) Int. Cl.
*F04C 14/28* (2006.01)
*F04C 14/06* (2006.01)

(52) U.S. Cl.
CPC ..... *F04C 14/28* (2013.01); *F04C 14/06* (2013.01); *F04C 2240/81* (2013.01); *F04C 2270/90* (2013.01)

(58) Field of Classification Search
CPC ..... F04B 17/03; F04B 2203/0208; F04B 2205/01; F04B 2205/05; F04B 2205/09; F04B 23/04; F04B 49/065; F04B 51/00; F04D 15/0088; F04D 27/001; F04C 14/28; F04C 14/06; F04C 2240/81; F04C 2270/90
See application file for complete search history.

(56) References Cited

U.S. PATENT DOCUMENTS

| | | | |
|---|---|---|---|
| 4,107,987 | A | 8/1978 | Robbins et al. |
| 4,473,338 | A | 9/1984 | Garmong |
| 5,291,777 | A | 3/1994 | Chang et al. |
| 9,013,322 | B2 | 4/2015 | Roberson et al. |

(Continued)

FOREIGN PATENT DOCUMENTS

| | | |
|---|---|---|
| CN | 201826893 | 5/2011 |
| CN | 203101941 | 7/2013 |

(Continued)

*Primary Examiner* — Francis C Gray

(74) *Attorney, Agent, or Firm* — Schmeiser, Olsen & Watts LLP

(57) ABSTRACT

A remote pump manager is provided. The remote pump manager includes pressure sensors or a depth sensor operating to determine the change in pressure of a pump, a flow sensor operating to determine flow rate of fluid exiting the pump, a power meter operating to determine power data related to operation of the pump, and a management device having a control device and a display. The pressure sensors, the flow sensor and the power meter are in communication with the management device. The management device operates to determine pump efficiencies, wherein the control device automatically determines pump efficiency data in response to receiving real time data from the pressure sensors, the flow sensor and the power meter and automatically delivers the pump efficiency data to the display for displaying the determined pump efficiency data.

18 Claims, 6 Drawing Sheets

(56) References Cited

U.S. PATENT DOCUMENTS

| | | | | |
|---|---|---|---|---|
| 9,080,438 | B1 | 7/2015 | McCoy et al. | |
| 2008/0190604 | A1 | 8/2008 | Hild et al. | |
| 2010/0106458 | A1* | 4/2010 | Leu | F04B 49/065 702/181 |
| 2013/0108473 | A1* | 5/2013 | Tamminen | F04B 23/04 417/3 |
| 2014/0202243 | A1* | 7/2014 | Leonard | F04B 23/021 73/168 |
| 2015/0308242 | A1 | 10/2015 | Suprick et al. | |
| 2016/0108715 | A1* | 4/2016 | Haines | E21B 41/00 348/85 |
| 2017/0030349 | A1* | 2/2017 | Bassett | F04B 51/00 |
| 2017/0089192 | A1* | 3/2017 | Rendusara | E21B 43/128 |
| 2017/0114625 | A1* | 4/2017 | Norris | E21B 47/0007 |
| 2017/0300027 | A1* | 10/2017 | Oyama | G07C 3/00 |

FOREIGN PATENT DOCUMENTS

| | | |
|---|---|---|
| CN | 203311247 | 11/2013 |
| CN | 104898579 A | 9/2015 |
| CN | 105028136 | 11/2015 |

* cited by examiner

REMOTE PUMP MANAGING DEVICE

CROSS REFERENCE TO RELATED APPLICATION[S]

This application is a continuation-in-part of the earlier U.S. Utility Patent Application entitled "REMOTE PUMP MANAGING DEVICE," Ser. No. 15/414,893, filed Jan. 25, 2017, the disclosure of which is hereby incorporated entirely herein by reference.

BACKGROUND OF THE INVENTION

Technical Field

This invention relates generally to management of a pump and more particularly to a remote pump manager.

State of the Art

Pumps are used for pumping water, oil and liquids and for other purposes. In general, systems that utilize pumps, such as water pumps or oil filed pumps, do not actively monitor the pumps. In many cases, as long as a pump is working, the pump is largely ignored. This leads to lower average Overall Pumping Efficiency ("OPE"). Pump owners rarely perform periodic pump tests, resulting in vast energy waste. For pump owners that do perform routine tests, these are conventionally snapshots of pump operation that do not capture the full range of its operation.

SUMMARY OF THE INVENTION

An embodiment includes a remote pump manager comprising: pressure sensors or a depth sensor operating to determine the change in pressure of a pump; a flow sensor operating to determine flow rate of fluid exiting the pump; a power meter operating to determine power data related to operation of the pump/prime mover; and a management device having a control device and a display, the pressure sensors, the flow sensor and the power meter in communication with the management device, and wherein the management device operates to determine pump efficiencies, wherein the control device automatically determines pump efficiency data in response to receiving real time data from the pressure sensors, the flow sensor and the power meter and automatically delivers the pump efficiency data to the display for displaying the determined pump efficiency data. The remote pump manager may include a communication device in the management device for sending the real time data to a remote server.

Another embodiment includes a remote pump manager comprising: a management device having a control device and a display, the management device operatively coupled to a pump wherein: the management device operates at predetermined intervals to determine pump efficiencies; the control device, during operation of the management device, automatically determines pump efficiency data in response to receiving real time pressure data, real time flow data and real time power data; and the control device, during operation of the management device, automatically delivers the pump efficiency data to the display for displaying the determined pump efficiency data.

Yet another embodiment includes a method of operating a remote pump manager, the method comprising: coupling a management device to at least one pump; sending pressure data of the at least one pump to the management device; sending flow data of the at least one pump to the management device; sending power data of the at least one pump to the management device; and automatically determining pump efficiency data of the at least one pump and delivering the pump efficiency data to a display of the management device for displaying the pump efficiency data. Determining the pump efficiency data comprises operating a control device of the management device to determine pump efficiency utilizing the pressure data, the flow data, and the power data.

Yet another embodiment includes a method of predicting cost of operating certain pumps by computing and displaying a $ per production volume of water pumped, the method comprising: coupling data from the device with local electric time of use utility rates to automatically determine the cost of pumping one acre foot of water at any given time and displaying it on the device. The computation shall use the most up-to-date data available such as kWh/AF, input kW and flow rate.

Yet another embodiment involves a level of predictive proactive maintenance recommendations using real time and historical data. By comparing different combinations of operational data and pump efficiency, the device can check for optimal efficiency. With additional inputs from vibration sensors, the device can also check for imminent failure. The device will continuously check developed head by pump against flow rate and vice versa. If the variances with historical data is outside predetermined levels, the device will send an alarm to the operator. Another check is on the operational efficiency. If the operational efficiency falls below certain limit, the device will send an alarm to the operator. The device will continue to learn from the different data points that it collects and improve the algorithm related to maintenance recommendations.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

As discussed above, embodiments of the present invention relate to a remote pump manager. The remote pump manager provides an efficient, reliable, pump monitoring system at an affordable cost. The remote pump manager may stream live data from the site via sensors. This data may be collected for determination of insightful calculations of pump efficiency, as well as energy use. In addition to monitoring, the remote pump manager may also include a management program that can control basic pump functions remotely.

Figure 1:
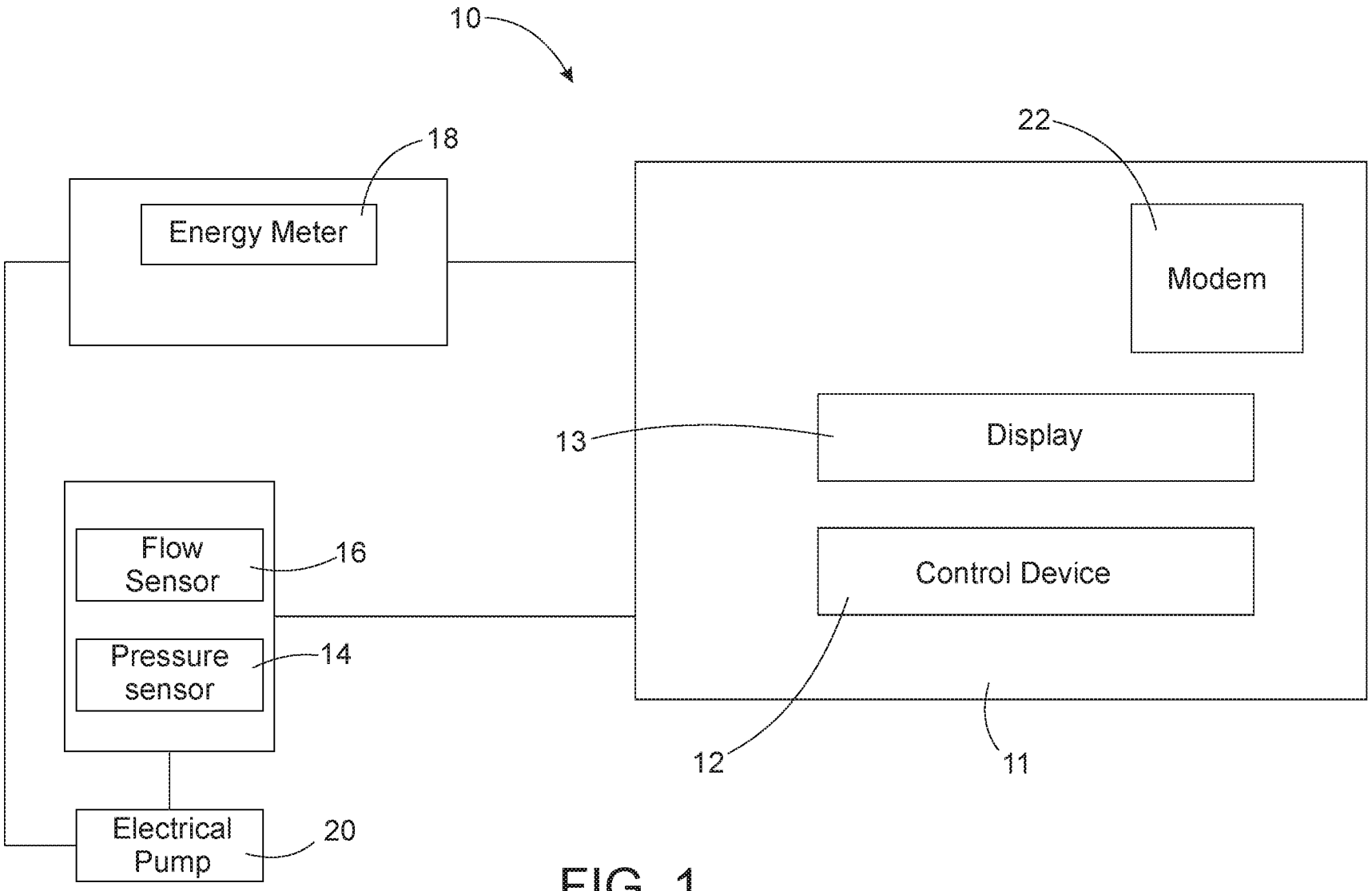
FIG. 1 is a schematic view of a management device of a remote pump manager, in accordance with an embodiment.
Figure 2:
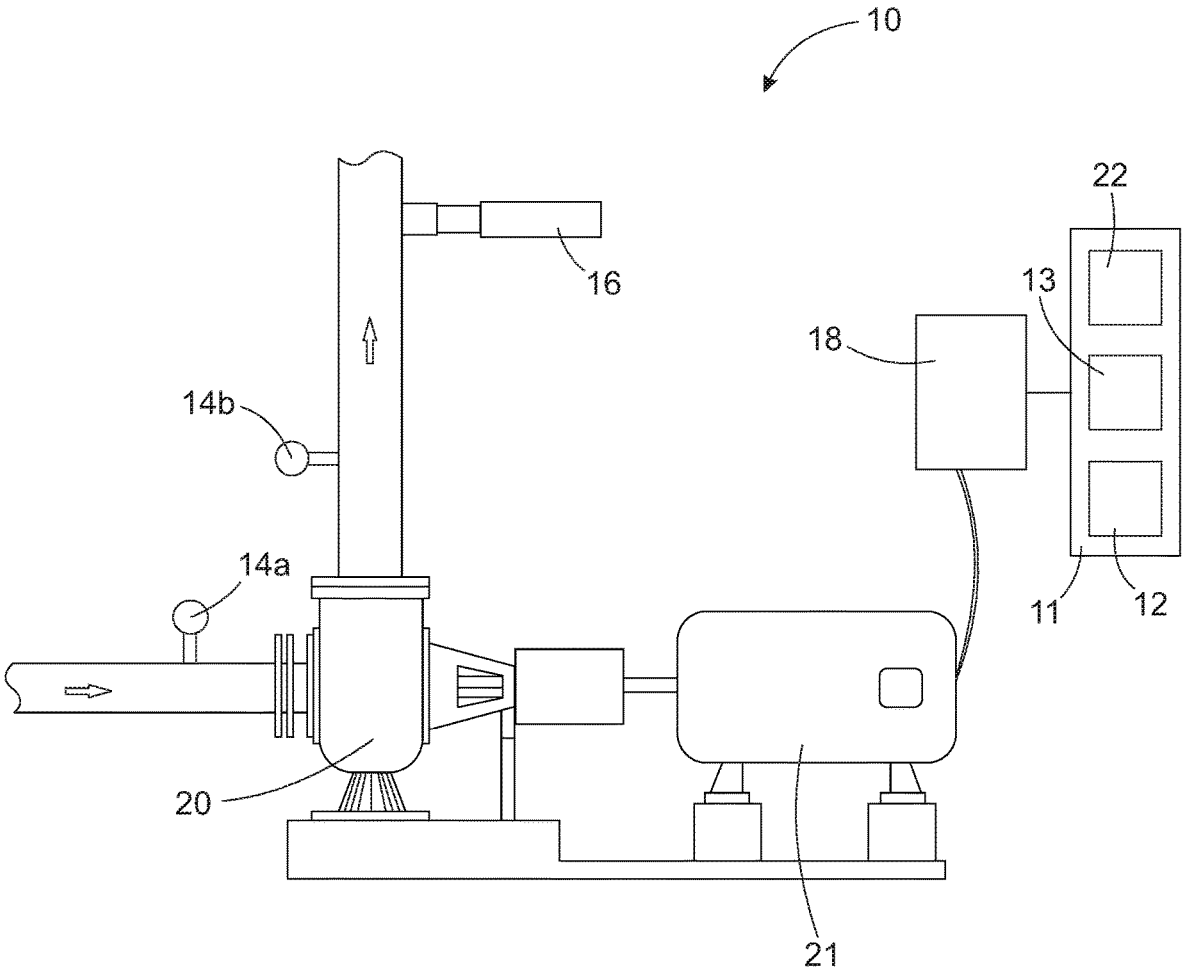
FIG. 2 is a view of a pump with a remote pump manager, in accordance with an embodiment.

FIGS. 1 and 2 depict a remote pump manager 10 according to an embodiment of the present invention. The remote pump manager 10 includes a management device 11 comprising control device 12, such as a programmable logic controller ("PLC") or any other type of controller, and a display 13, at least one pressure sensor 14, a flow sensor 16, and a power meter 18. The management device 11 may include a communication device 22, such as a modem, a network device, a wired connection device, a wireless connection device or other type of communication device that allows for wired or wireless communication. The remote pump manager 10 may include a pump 20.

Referring specifically to FIG. 2, the remote pump manager 10 comprises the control device 12, the display 13, a first pressure sensor 14*a*, a second pressure sensor 14*b*, the flow sensor 16, the power meter 18, the pump 20 and the communication device 22. The first pressure sensor 14*a* is coupled to a pipe flowing into the pump 20 and the second pressure sensor 14*b* is coupled to a pipe flowing out of the pump 20. The flow meter is coupled to the pipe flowing out of the pump 20. The power meter 18 is coupled to a motor 21 that supplies power to the pump 20. The management device 11 may be in communication with the first pressure sensor 14*a*, the second pressure sensor 14*b*, the flow sensor 16, and the power meter 18.

The management device 11 operates to determine pump efficiencies. This occurs by the control device 12 automatically determining pump efficiency data in response to receiving real time data from the first pressure sensor 14*a*, the second pressure sensor 14*b*, the flow sensor 16 and the power meter 18. The control device 12 utilizes the measurement of flow, differential pressure, and power to determine pump efficiency.

The flow sensor 16 may be a paddlewheel flow type sensor that works for a large range of pipe diameters and flow rates. The flow sensor 16 may be a clamp on ultrasonic flow meter has the benefit of easy installation, and wide range of use. The flow sensor 16 may be any other type of flow meter.

Measuring pressure may require a simple pressure transmitter on the suction (first pressure sensor 14*a*) and discharge (second pressure sensor 14*b*) of the pump 20. In some embodiments, however, it may be difficult to install a pressure transmitter on the suction side of the pump 20. This difficulty arises when the pipe comes directly from the ground into the pump 20, such as but not limited to a well pump, with no straight section for a low turbulence measurement. In these embodiments, the physical parameters of the system will be used to determine suction head using a head sensor or a depth sensor. The suction pressure/head sensor is dependent on the location of the water source. If the water source is above the pump centerline, then the suction head will be a positive number. If the water source is below the center line, the suction head is a negative number. This can be combined with the discharge head to find the total dynamic head. The total dynamic head data may operate as pressure data or be used with the efficiency calculation performed by the control device 12.

The remote pump manager 10 may operate to monitor power, energy, and power factor by use of a power meter 18. While power is a direct factor on pump efficiency, the other quantities are useful for cost analysis. The power meter 18 may measure voltage and current inputs and then return energy use. To work, the meter 18 may require current transformers (CTs) to measure the current. Split core CTs are preferred due to their installation requirements. The CTs output a standard 0-5 A, which the meter combines with the voltage reading to yield energy use. Specifically, the meter 18 finds active power, reactive power, and apparent power. The power meter 18 may also convert these power readings into energy readings by factoring for time.

The control device 12 operates to determine pump efficiency. The method uses Bernoulli's equations to find pump efficiency. Sensors find flow, pressure difference across the pump, and energy consumption by the motor. These quantities, along with constants specific to a pump, provide the necessary information to properly find pump efficiency. The calculations include:

$$Ef = \eta_{pump} = \frac{\text{Water Horsepower}}{\text{Brake Horsepower}} = \frac{WHP}{BHP} \quad \text{(i)}$$

$$WHP = \rho g Q H = \frac{QH}{3956} \quad \text{(ii)}$$

$$BHP = HP_{in} \cdot \eta_{motor} \quad \text{(iii)}$$

$$H = \Delta Z + h_f + \frac{P_2 - P_1}{\rho g} + \frac{V_2^2 - V_1^2}{2g} \quad \text{(iv)}$$

$$\eta_{pump} = \frac{Q * \left(\Delta Z + h_f + \frac{P_2 - P_1}{\rho g} + \frac{V_2^2 - V_1^2}{2g}\right)}{\text{kW}/.746 * \eta_{motor}} \quad \text{(v)}$$

Equation (v) is the form used to find efficiency, wherein all variables in equation (v) are known, constant, or sensor measured.

A simplified formula may be used by the control device 12 for calculating efficiency of the pump 20 may be:

$$Ef = \eta_{pump} = \frac{QH}{3956 * HP} \quad \text{(vi)}$$

For equations (i)-(vi) the following is a description of variables of the equations and how the variables are obtained:

| | | |
|---|---|---|
| ΔZ | Change in height between pressure measurements | Measured once, Constant |
| $h_f$ | Friction Loss | Measured once, Constant |
| V | Velocity | Derived from Flow and Pipe Diameter |
| ρ | Fluid Density | Known Constant |
| g | Acceleration due to Gravity | Known Constant |
| Q | Flow Rate | Sensor Measured |
| HP | kW/.746 | Sensor Measured |
| P | Pressure | Sensor Measured |

Once the control device 12 determines the pump efficiency data, that pump efficiency data is sent to the display 13 and the display 13 operates to display the pump efficiency data for a user to view and operate the pump 20 in accordance with the pump efficiency data.

For purposes of this disclosure and by way of example only, the pressure sensors 14, flow sensor 16, and power meter 18 must use some form of an electrical signal to transmit data. The signals may be analog or digital. Analog signals involve some form of differential measurement whereas digital signals are of the form on or off. Analog signals have an advantage because they can be transmitted in a variety of ways. There are two predominant methods of analog signaling, namely differential voltage 0-10V, and 4-20 mA current loop. Both signals have useful functions. In the voltage method, a sensor modulates its internal resistance to produce different voltage drops. A data recording device then measures the voltage drop across the sensor and works out what the resistance is. Each resistance value corresponds to an analog value that is programmed within the data recorder. The current loop functions in a very similar fashion but has a subtle difference. It again modulates its internal resistance, but does so to produce different currents in the current loop. The data recorder has an internal resistor of a known value. By recording the voltage drop across the resistor, the current flowing through it is apparent. This current corresponds with a unique sensor value.

Voltage signals are useful because the hardware is very simple, and the measurement is excessively easy to make. The voltage signal suffers in that it is easily affected by field noise and interference. The voltage signal also drops, or decays, over long distances due to the internal resistance of the wires. The current loop avoids these problems, at a slightly higher cost. The current will not change as the signal is carried along longer wires. The current along any circuit loop is constant as defined by Kirchhoff's Current Law. This allows current signals to be carried for much greater distances without any loss in quality. As mentioned above, the current loop requires an additional resistor within the data recorder so that it may interpret the current value. Either analog signal may be utilized with a remote pump manager 10.

In embodiments that report to a remote location or a central location, the communication device 22 of the management device 11 communicates the real time data from the pressure sensors 14, the flow sensor 16 and the power meter 18 to a server 40. The server 40 automatically determines pump efficiency data in response to receiving real time data from the pressure sensors 14, the flow sensor 16 and the power meter 18. In embodiments, the control device 12 interrupts the communication between the communication device 22 and the server 40 prior to automatically determining pump efficiency data by the control device 12, thereby allowing communication with the display 13 to provide pump efficiency data. If the communication device malfunctions or communication between the communication device 22 and the server 40 is lost, the control device 12 operates to cache or store pressure data, flow data and power data along with the time associated with the data, and once the communication link between the communication device 22 and the server 40 is reestablished, the communication device may send the stored data to the server for processing. During times when the communication device 22 communication link with the server is down, the control device 12 may still determine pump efficiency and communicate the same to the display 13.

Figure 3:
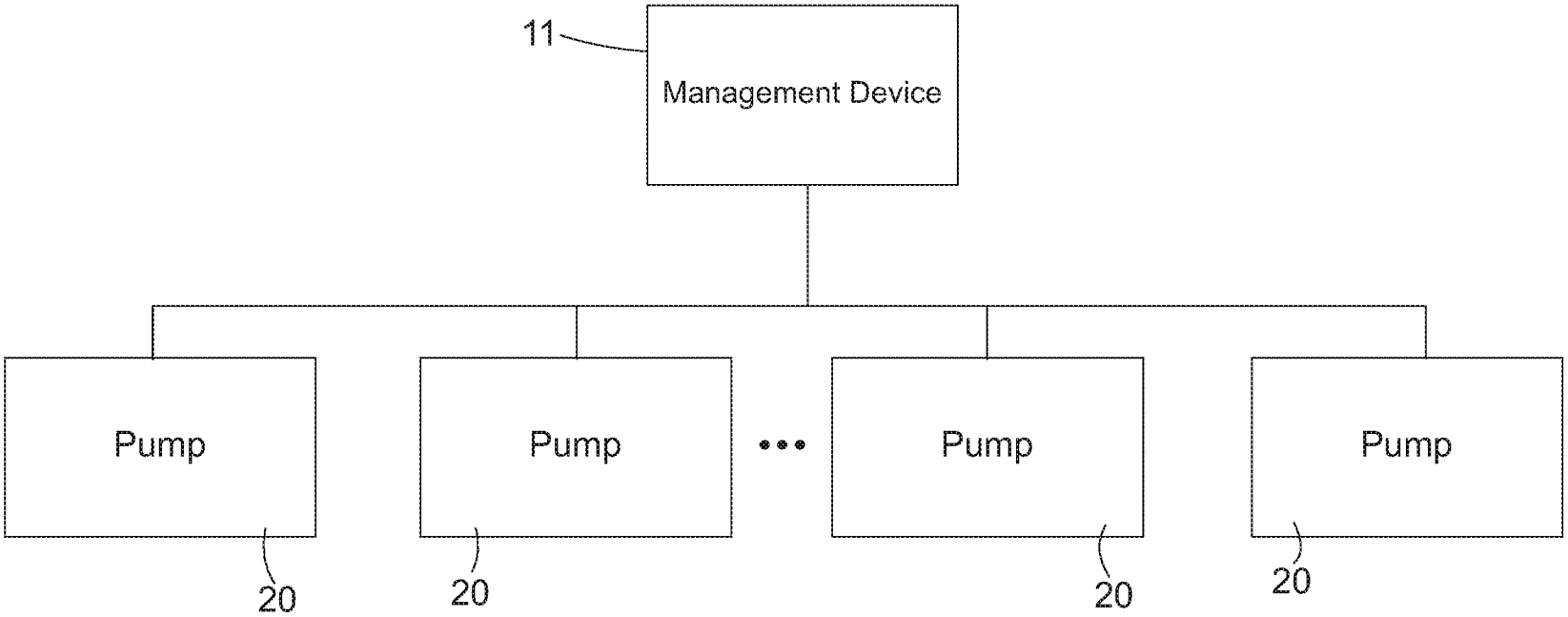
FIG. 3 is a schematic view of a remote pump manager operatively coupled to a plurality of pumps, in accordance with an embodiment.

Referring further to the drawings, FIG. 3 depicts a managing device 11 operating with a plurality of pumps 20. In these embodiments, the pump efficiency is determined for each pump of the plurality of pumps 20 in the manner described above. The pump efficiency data for each pump 20 may be displayed on display 13 in response to the control device 12 sending the efficiency data for each pump 20 to the display 13. Further, the communication device 22 may communicate the pressure data, flow data and power data for each pump 20 of the plurality of pumps to the server 40 wherein the server 40 operates as previously described.

In embodiments, the remote pump manager 10 includes is vibration sensor. The vibration sensor operates to monitor the vibration of the pump 20. The remote pump manager 10 may be programmed to determine whether the vibration of the pump 20 is outside of a predetermined threshold and communicate the same to the display 13. The vibration outside of the threshold is an additional amount of data that can be analyzed to determine the efficiency of the pump 20 or to determine if repairs are needed for the pump 20. The remote pump manager 10 may send the data to the server.

Further, in some embodiments, the remote pump manager 10 may include data collectors, that may include sensors or the like, to form a quality meter, that determine the quality of the product being pumped. The data collectors can obtain data with regard to the quality of the product being pumped and communicate the data in order to determine if the product quality is within an acceptable range of quality. If the quality data is outside of an acceptable range, the remote pump manager 10 may then communicate the same to the display 13. The remote pump manager 10 may also communicate the product quality information to the server.

In the embodiments shown in FIGS. 1-3, it will be understood that the server may be programmed to alert a pump owner of the status of each pump 20, and may further provide an alert suggesting certain action or pump control. In some embodiments, the server may be programmed to allow user control of the pumps being monitored by the remote pump manager 10. Further still, the server may be programmed to automatically perform some pump control functions based on the data returned from the remote pump manager 10.

Figure 4:
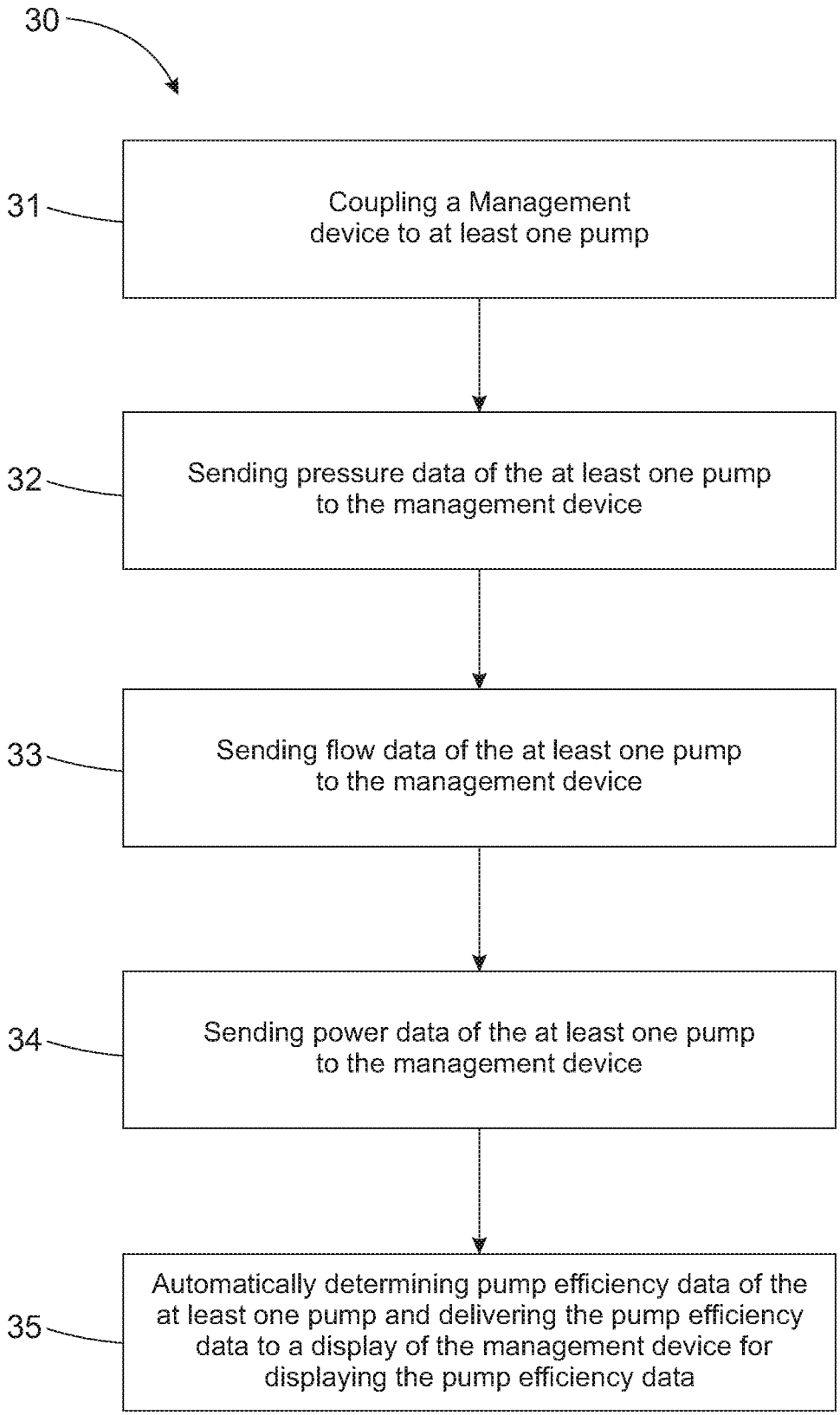
FIG. 4 is a flow diagram of a method of using a remote pump manager, in accordance with an embodiment.

Referring to FIG. 4, another embodiment of the present invention includes a method 30 of using a remote pump manager 10. The method 30 comprises coupling a management device to at least one pump (Step 31); sending pressure data of the at least one pump to the management device (Step 32); sending flow data of the at least one pump to the management device (Step 33); sending power data of the at least one pump to the management device (Step 34); and automatically determining pump efficiency data of the at least one pump and delivering the pump efficiency data to a display of the management device for displaying the pump efficiency data (Step 35).

In method 30, Step 35 of automatically determining pump efficiency data may include operating a control device of the management device to determine pump efficiency utilizing the pressure data, the flow data, and the power data. Additionally, the method may include communicating the pressure data, the flow data and the power data to a server. The data may be communicated from sensors as described previously in a manner as described previously.

Figure 5:
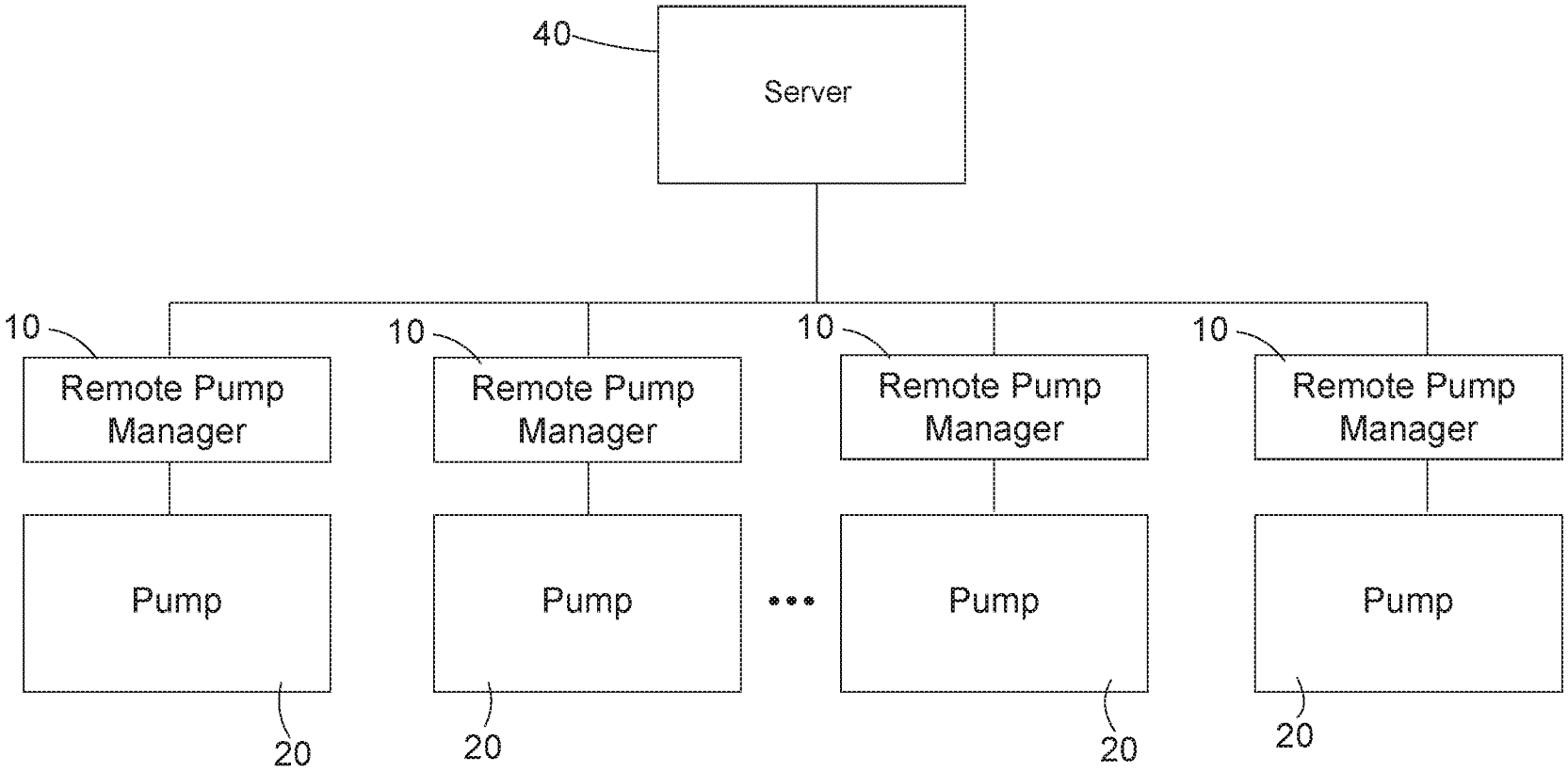
FIG. 5 is a schematic view of a remote pump management system, in accordance with an embodiment.

Referring further to the drawings, FIG. 5 depicts another embodiment that includes a remote pump management system 50. The system 50 includes a plurality of pumps 20 and a plurality of remote pump managers 10, each pump 20 having one remote pump manager 10. The plurality of pump managers 10 is coupled to a server 40, wherein each pump manager 10 is in communication with the server 40 to send and receive data to and from the server 40. Each pump manager 10 operates to obtain pump data and send the obtained pump data to the server 40. The server 40 may be programmed to process the data once received. The server 40 may include a pump database stored in memory of the server 40, and a software programmed application. The application may include program code that is operational by a processor of the server 40.

Figure 6:
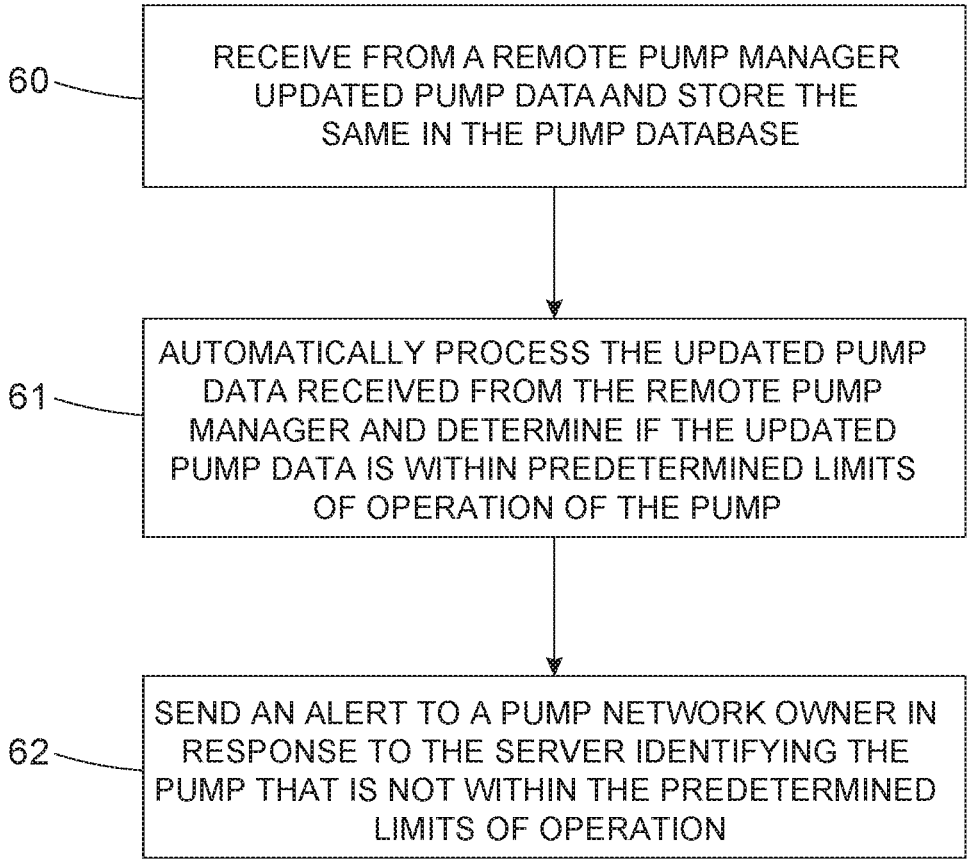
FIG. 6 is a flow diagram of programming steps performed by a server of a remote pump management system, in accordance with an embodiment.

In operation, the server 40 may include a memory having a pump database storing pump data corresponding to each pump 20 in a network (or plurality) of pumps 220 that form a portion of the remote pump management system 50. The pump data includes a pump identification information and pump operational information associated with the pump identification information. Each of the plurality of remote pump managers 10 may be coupled to the server 40, and, referring to FIG. 6, the server 40 may be programmed to receive from a remote pump manager 10 updated pump data and store the same in the pump database (Step 60), wherein the updated pump data includes pump identification information and current pump operational information associated with the pump identification information including a time that the current pump operational information was obtained, and wherein the current pump operational information is stored in the pump database and associated with the pump identification information; automatically process the updated pump data received from the remote pump manager 10 and determine if the updated pump data is within predetermined limits of operation of the pump 20 (Step 61); and send an alert to a pump network owner in response to the server 40 identifying the pump that is not within the predetermined limits of operation (Step 62). The pump owner may then take necessary action based on the alert if the alert is made. The system 50 includes performing the same operation for each pump of the network of pumps 20. This may occur simultaneously or on a first-in-first-out operation at the server 40.

In embodiments, the system 50 may include the server 40 programmed to automatically determine pump operational changes to be made in response to the pump operating outside of the predetermined limits of operation; and send data to the remote pump manager 10 instructions to perform the pump operational changes. For example and without limitation, the remote pump manager for a pump may send updated pump data that includes a total head to the server; the server processes the updated pump data and determines that the total head of the pump is below the predetermined limit of operation and determines the pump should be shutdown; and the server sends instructions to the remote pump manager to shutdown the pump, wherein the remote pump manager operates to shutdown the pump.

In embodiments, the system 50 stores historical data for each pump 20 of the network of pumps 220. The server 40 may then be programmed to analyze historical data each time the server receives updated pump data from the network of pumps 220. The server 40 may analyze data and determine certain pump operational information for the entire network of pump 220 that existed at the time of an operational failure, such as a pump failure. The server 40 may then be programmed to analyze and determine the pump operational information of the entire network of pumps 220 prior to failure to determine trends in the data that can predict a future failure. The server 40 in at least this way operates with artificial intelligence in order to make rational decisions based on historical pump data in order to predict future operational issues of any pump within the network of pumps 220. The server 40 may be programmed to send control data to a remote pump manager of one or more pumps in order to alter pump operations based on the updated pump data of all of the pumps of the network of pumps 220.

Another embodiment includes a method of predicting cost of operating certain pumps by computing and displaying a $ per production volume of water pumped, the method comprising: associating data from the device with local electric time of use utility rates to automatically determine the cost of pumping one production volume of fluid, such as water, at any given time and displaying the determined cost on the device. The computation may use the most up-to-date data available such as kWh/production volume, input kW and flow rate.

Another embodiment may include a level of predictive proactive maintenance recommendations using real time and historical data. By comparing different combinations of operational data and pump efficiency, the system 50 can check for optimal efficiency. With additional inputs from vibration sensors, the system 50 can also check for imminent failure. The system 50 will continuously check developed head by pump against flow rate and vice versa. If the variances with historical data is outside predetermined levels, the system 50 may send an alarm and/or message to the operator and/or display the same on a screen of the system 50, wherein the message include variances to design conditions. Another check may be performed on the operational efficiency. If the operational efficiency falls below certain limit (a predetermined limit), the system 50 may send an alarm to the operator. The system 50 will continue to learn from the different data points that it collects and stores within memory improve the algorithm related to maintenance recommendations. It will be understood that the system 50 may include a server remote to a control device and the management device. In other embodiments, the system 50 may be assembled in a single device and coupled to a pump.

It will be understood that the system 50 may utilize any one of the various types of sensors as previously discussed, including flow rate sensors, pressure sensors, power meters, vibration sensors, quality meter and any combination of one or more of these sensor types to obtain the updated pump data by the remote pump manager 10.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A remote pump manager comprising:

pressure sensors or a depth sensor operating to determine the change in pressure of a pump;

a flow sensor operating to determine flow rate of fluid exiting the pump;

a power meter operating to determine power data related to operation of the pump; and a management device having a control device and a display, the management device coupled to a server, wherein the pressure sensors, the flow sensor and the power meter are in communication with the management device, and wherein the management device operates to determine pump efficiencies, wherein the control device automatically determines pump efficiency data in response to receiving real time data from the pressure sensors, the flow sensor and the power meter and automatically delivers the pump efficiency data to the display for displaying the determined pump efficiency data and sends data from the sensors and the pump efficiency data to the server, wherein the server analyzes historical data for the pump to predict a future failure of the pump.

2. The remote pump manager of claim 1, wherein the management device operates at predetermined intervals.

3. The remote pump manager of claim 1, further comprising a vibration sensor.

4. The remote pump manager of claim 3, wherein the control device automatically determines pump operational data in response to receiving real time data from the vibration sensor and automatically delivers the pump operational data to the display for displaying the determined pump operational data.

5. The remote pump manager of claim 1, further comprising a product quality meter.

6. The remote pump manager of claim 5, wherein the control device automatically determines pump quality data in response to receiving real time data from the product quality meter and automatically delivers the pump quality data to the display for displaying the determined pump quality data.

7. A remote pump manager comprising:

a management device having a control device and a display, the management device operatively coupled to a pump and coupled to a server wherein:

the management device operates at predetermined intervals to determine pump efficiencies;

the control device, during operation of the management device, automatically determines pump efficiency data in response to receiving real time pressure data, real time flow data and real time power data; and the control device, during operation of the management device, automatically delivers the pump efficiency data to the display for displaying the determined pump efficiency data and sends pressure data, flow data, power data and the pump efficiency data to the server, wherein the server analyzes historical data for the pump to predict a future failure of the pump.

8. The remote pump manager of claim 7, further comprising pressure sensors for providing real time pressure data.

9. The remote pump manager of claim 7, further comprising a head sensor for determining the total head of the pump and automatically determining pressure data from the total head of the pump.

10. The remote pump manager of claim 7, further comprising a flow sensor for measuring the flow of fluid leaving the pump.

11. The remote pump manager of claim 7, further comprising a power meter for measuring the power supplied to the pump.

12. The remote pump manager of claim 7, further comprising a vibration sensor.

13. The remote pump manager of claim 12, wherein the control device automatically determines pump operational data in response to receiving real time data from the vibration sensor and automatically delivers the pump operational data to the display for displaying the determined pump operational data.

14. The remote pump manager of claim 7, further comprising a product quality sensor.

15. The remote pump manager of claim 14, wherein the control device automatically determines product quality data in response to receiving real time data from the product quality sensor and automatically delivers the pump quality data to the display for displaying the determined pump quality data.

16. The remote pump manager of claim 7, wherein the management device is operatively coupled to a plurality of pumps.

17. The remote pump manager of claim 16, wherein the management device operates at the predetermined intervals to determine pump efficiencies of each of the plurality of pumps.

18. A remote pump manager comprising:

pressure sensors or a depth sensor operating to determine the change in pressure of a pump;

a flow sensor operating to determine flow rate of fluid exiting the pump;

a power meter operating to determine power data related to operation of the pump;

a vibration sensor operating to determine vibration of the pump; and a management device having a control device and a display, the pressure sensors, the flow sensor and the power meter in communication with the management device, and wherein the management device operates to determine pump efficiencies, wherein the control device automatically determines pump efficiency data in response to receiving real time data from the pressure sensors, the flow sensor and the power meter and automatically delivers the pump efficiency data to the display for displaying the determined pump efficiency data, and wherein the control device automatically determines pump operational data in response to receiving real time data from the vibration sensor and automatically delivers the pump operational data to the display for displaying the determined pump operational data.

* * * * *